US010392826B2

(12) United States Patent
Pannekoek et al.

(10) Patent No.: US 10,392,826 B2
(45) Date of Patent: Aug. 27, 2019

(54) TOOL FOR USE IN MODIFYING POLES

(71) Applicant: Swivelpole Patent Pty Ltd, Mandurah, Western Australia (AU)

(72) Inventors: Robert John Pannekoek, Mandurah (AU); Peter Pannekoek, Mandurah (AU)

(73) Assignee: SWIVELPOLE PATENT PTY LTD, Mandurah, Western (AU)

( * ) Notice: Subject to any disclaimer, the term of this patent is extended or adjusted under 35 U.S.C. 154(b) by 837 days.

(21) Appl. No.: 14/888,174

(22) PCT Filed: May 1, 2014

(86) PCT No.: PCT/AU2014/000479

§ 371 (c)(1),
(2) Date: Oct. 30, 2015

(87) PCT Pub. No.: WO2014/176633

PCT Pub. Date: Nov. 6, 2014

(65) Prior Publication Data

US 2016/0069098 A1 Mar. 10, 2016

(30) Foreign Application Priority Data

May 1, 2013 (WO) ..... PCT/AU2013/000453

(51) Int. Cl.

| | |
|---|---|
| ***E04H 12/18*** | (2006.01) |
| ***F21V 21/116*** | (2006.01) |
| ***F21V 21/36*** | (2006.01) |

(52) U.S. Cl.
CPC ..... *E04H 12/187* (2013.01); *F21V 21/116* (2013.01); *F21V 21/36* (2013.01)

(58) Field of Classification Search
CPC ..... E04H 12/187; F21V 21/36; F21V 21/116
See application file for complete search history.

(56) References Cited

U.S. PATENT DOCUMENTS 1,679,513 A * 8/1928 Brown ..... E04H 12/187 135/114
2,100,058 A * 11/1937 McGrady ..... E04H 12/182 248/159

(Continued)

FOREIGN PATENT DOCUMENTS

EP 2 031 155 3/2009 ..... E04H 12/18
WO WO 01/25687 4/2001 ..... F21V 21/36

(Continued)

OTHER PUBLICATIONS

International Search Report for International Application No. PCT/AU2014/000479, dated Jun. 13, 2014.

(Continued)

*Primary Examiner* — Moshe Wilensky
*Assistant Examiner* — Kyle A Cook
(74) *Attorney, Agent, or Firm* — Kusner & Jaffe

(57) ABSTRACT

A method of installing a joint into a light pole is described. The method includes the steps of supporting the light pole during cutting, then lowering a free portion of the lightpole about a hinge. The hinge is configured such that when a free portion of the light pole is lowered, wiring internal of the light pole is not significantly stretched.

16 Claims, 12 Drawing Sheets

(56) References Cited

U.S. PATENT DOCUMENTS

| | | | | |
|---|---|---|---|---|
| 2,577,811 | A * | 12/1951 | Rutledge | E04H 12/187 16/250 |
| 5,124,899 | A | 6/1992 | Hale | 362/253 |
| 6,793,021 | B1 | 9/2004 | Fanguy | 166/380 |
| 6,957,832 | B1 * | 10/2005 | Pannekoek | E04H 12/187 248/122.1 |
| 2009/0245994 | A1 | 10/2009 | Ritola | 414/774 |
| 2014/0307452 | A1 | 10/2014 | Pannekoek | 362/396 |

FOREIGN PATENT DOCUMENTS

| | | | | |
|---|---|---|---|---|
| WO | WO 03/029581 | | 4/2003 | E04H 12/18 |
| WO | WO 03029581 | A2 * | 4/2003 | E04H 12/187 |

OTHER PUBLICATIONS

International Search Report and Written Opinion for International Application No. PCT/AU2012/001354, dated Dec. 3, 2012.

Patent Examination Report No. 2 for related Australian Patent Application No. 2013202203, dated Dec. 12, 2013.

* cited by examiner

TOOL FOR USE IN MODIFYING POLES

FIELD OF THE INVENTION

The present invention relates to the 'retro-fitting' of joints such as hinged joints or pivoting joints into poles, particularly light poles.

BACKGROUND TO THE INVENTION

The Swivelpole™ is described in the International Patent Application No. PCT/AU00/01208, published as WO0125687. This product consists of a light pole which has a swivelling joint along its length. The swivelling joint allows the light pole to be readily and safely raised or lowered in order for maintenance to be performed on a light or lamp.

While light poles incorporating the Swivelpole™ joint have proved highly useful, with significant cost savings and safety improvements for light maintenance, it has not always been economically viable for existing light poles to be removed and replaced by swivelling light poles.

Rather than the removal and replacement of existing light poles by Swivelpoles™, it has been possible to insert a swivelling joint into existing light poles. Often, such an operation has proved to be awkward, time consuming, and expensive. For example, extensive scaffolding may be required in order for a single joint to be fitted.

It is considered desirable to provide a tool which allows significant change to an elevated light, such as the insertion of a swivel joint without the need for extensive scaffolding.

The internal wiring of light poles has led to further problems in the retro-fitting of swivelling joints. Although means have been developed to support and hold an upper portion of a light pole when a cut is made into it, the lowering of these upper portions has frequently resulted in the stretching of and damage to internal wiring.

It is also considered desirable to provide a method of inserting a swivelling joint without damaging the internal wiring.

The present invention has been created in light of these desires.

SUMMARY OF THE INVENTION

According to one aspect of the present invention there is provided a supporting structure for use in modifying a pole, the pole having a longitudinal axis and a characteristic thickness, the supporting structure including:

- a first arm having a first locator, the first locator being arranged to releasably attach to the pole;
- a second arm having a second locator, the second locator being arranged to releasably attach to the pole;
- a further arm connecting the first arm and the second arm, the first arm including a first portion and a second portion connected at a hinge, the hinge having a hinge axis about which the first portion can rotate relative to the second portion;
- the hinge axis being perpendicular to the longitudinal axis of the pole when the first and second locators are attached to the pole;
- the hinge axis being spaced from the longitudinal axis of the pole by a distance no greater than the characteristic thickness of the pole;
- whereby rotation of the first portion relative to the second portion about the hinge causes the second arm to move between a first position in which the first and second locators are aligned, and a second position in which the first and second locators are not aligned.

According to a second aspect of the present invention there is provided a supporting structure for use in modifying a pole, the pole having a longitudinal axis, the supporting structure including:

- a first arm having a first locator, the first locator being arranged to releasably attach to the pole;
- a second arm having a second locator, the second locator being arranged to releasably attach to the pole;
- a further arm connecting the first arm and the second arm, the first arm including a first portion and a second portion connected at a hinge, the hinge having a hinge axis about which the first portion can rotate relative to the second portion;
- the first arm, the second arm and the hinge axis all being parallel to each other;
- whereby rotation of the first portion relative to the second portion about the hinge causes the second arm to move between a first position in which the first and second locators are aligned, and a second position in which the first and second locators are not aligned.

Preferably, the first arm, the second arm, and the hinge axis are all perpendicular to the longitudinal axis of the pole when the first and second locators are attached to the pole and the second arm is in the first position.

According to a third aspect of the present invention there is provided a method of preparing a pole for installation of a joint, the pole having a longitudinal axis, the method including the steps of:

- attaching a supporting structure to the pole, the supporting structure attaching to the pole at two longitudinally separated locations;
- cutting the pole at a joint location between the longitudinally separated locations, thereby creating a fixed portion of the pole and a free portion of the pole, the free portion of the pole being held into position relative to the fixed portion of the pole by the supporting structure; and
- rotating the free portion of the pole relative to the fixed portion of the pole about a hinge of the supporting structure, the hinge having a hinge axis within a characteristic thickness of the pole from the longitudinal axis.

According to a fourth aspect of the present invention there is provided a method of preparing a pole for installation of a joint, the method including the steps of:

- attaching a supporting structure to the pole, the supporting structure attaching to the pole at two longitudinally separated locations;
- cutting the pole at a joint location between the longitudinally separated locations, thereby creating a fixed portion of the pole and a free portion of the pole, the free portion of the pole being held into position relative to the fixed portion of the pole by the supporting structure;
- attaching a hinged support about the joint location, with the hinged support attaching to the fixed portion of the pole and the free portion of the pole; removing the supporting structure; and
- rotating the free portion of the pole relative to the fixed portion of the pole about a hinge of the hinged support.

The above methods may include the further step of removing wiring from the free portion of the pole.

According to a fifth aspect of the present invention there is provided a method of installing a joint in a pole, the method including the steps of:

attaching a supporting structure to the pole, the supporting structure attaching to the pole at two longitudinally separated locations;

cutting the pole at a joint location between the longitudinally separated locations, thereby creating a fixed portion of the pole and a free portion of the pole, the free portion of the pole being held into position relative to the fixed portion of the pole by the supporting structure;

attaching a hinged support to the pole about the joint location, with the hinged support attaching to the fixed portion of the pole and the free portion of the pole;

removing the supporting structure;

rotating the free portion of the pole relative to the fixed portion of the pole about a hinge of the hinged support;

removing wiring from the free portion of the pole;

removing the free portion of the pole and the hinged support; and attaching a joint to the fixed portion of the pole at the joint location.

The pole is preferably a light pole, and most preferably a light pole in excess of 2 m in height.

The hinged support preferably comprises a first member and a second member, each of the first member and the second member having attachment portions for attaching to the pole, the first member and the second member being connected such that the first member can rotate relative to the second member about a hinge axis.

The hinge axis is preferably perpendicular to a longitudinal axis of the pole.

The pole has a characteristic thickness, which in the case of a cylindrical pole is the diameter of the pole. The arrangement is such that when the hinged support is attached to the pole, the hinge axis is within a characteristic thickness of the longitudinal axis of the pole. It is preferred that the hinge axis is spaced from the longitudinal axis of the pole at a distance of about half the characteristic thickness. In the case of a cylindrical pole, therefore, the hinge axis is spaced from the longitudinal axis of the pole by about the radius of the pole; that is, the hinge axis is close to tangential to the pole.

In a most preferred embodiment the hinge axis is tangential to the pole.

The first member and the second member of the hinged support may each include two connection portions, laterally spaced such that when the hinged support is attached to the pole the first connection portions of the first and second members may be located on one side of the pole, and the second connection portions of the first and second members may be located on an opposite side of the pole.

The first connection portion of the first member may be connected to the first connection portion of the second member by an axial connecting member such as a bolt. The second connection portion of the first member may be connected to the second connection portion of the second member by an axial connecting member such as a bolt. In this arrangement the two axial connecting members are both located along the hinge axis.

The first connection portion of the first member and the first connection portion of the second member may both include subsidiary apertures. The arrangement may be such that a first aperture of the first member may be aligned with a first aperture of the second member when the hinged support is in a first configuration; namely, when the first member and the second member are aligned such that, in use, the fixed portion of the pole and the free portion of the pole may be aligned. The first aperture of the first member may be aligned with a second aperture of the second member when the hinged support is in a second configuration; namely, when the second member has been rotated relative to the first member such that, in use, the fixed portion of the pole and the free portion of the pole are perpendicular.

The methods above may include the step of locking the hinged support in its first configuration before removal to the attachment portion. They may also include the step of locking the hinged support in its second configuration following rotation of the free portion of the pole. The locking of the hinged support in a configuration may be achieved by the passing of a pin through the first aperture of the first member and an aligned aperture of the second member.

BRIEF DESCRIPTION OF THE DRAWINGS

It will be convenient to further describe the invention with reference to preferred embodiments of the present invention. Other embodiments are possible, and consequently the particularity of the following discussion is not to be understood as superseding the generality of the preceding description of the invention. In the drawings.

DETAILED DESCRIPTION OF PREFERRED EMBODIMENTS

Referring first to FIGS. 1 to 14, FIGS. 1 to 10 show a method of installing a joint 12, such as a Swivelpole™ joint, into a light pole 10. The method employs two particular pieces of equipment, a supporting structure 110 and a hinged support 210. These items, shown in FIGS. 11 to 14, will be described before the method of installing a joint is detailed.

Figure 11:
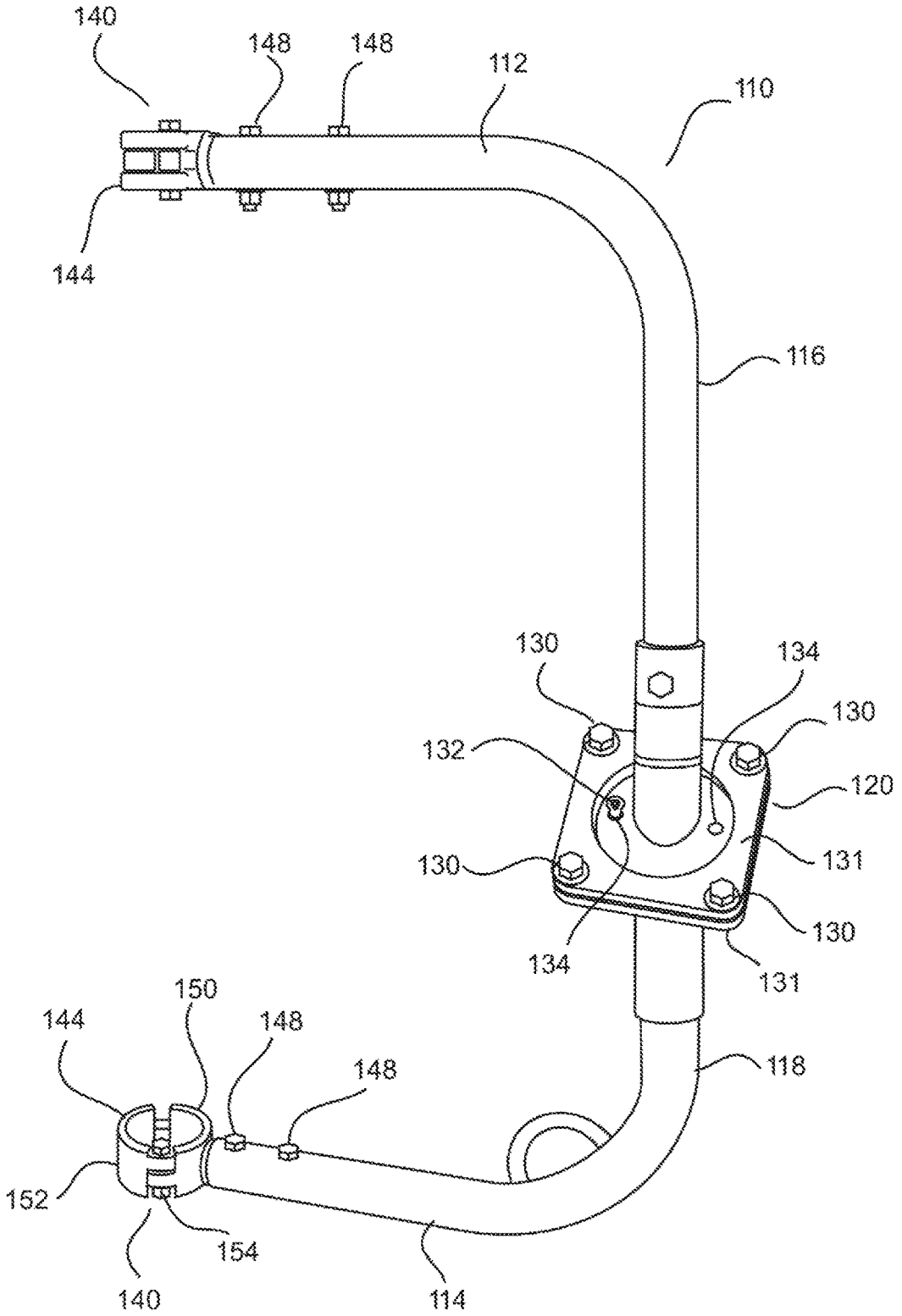
FIG. 11 is a perspective of a supporting structure used in the method of FIGS. 1 to 10.

Referring to FIG. 11, there can be seen a supporting structure 110 comprising a first arm 112, a second arm 114, and a further arm having a first portion 116 and a second portion 118.

Figure 2:
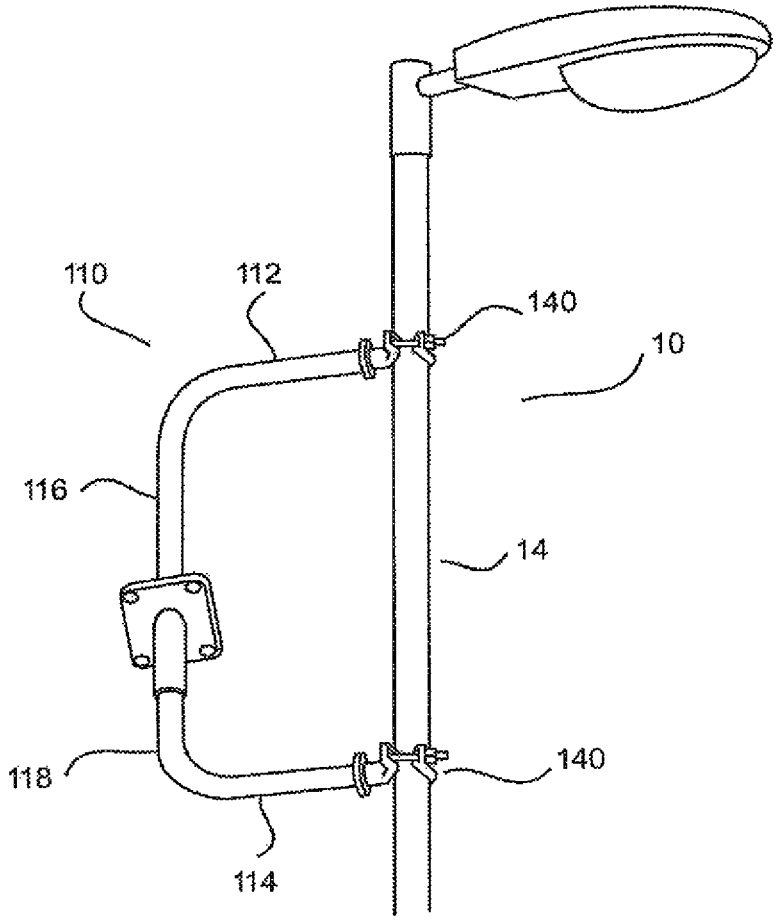

In the position shown in FIG. 2 the first arm 112 and the second arm 114 are generally horizontal, and the first and second portions 116, 118 of the further arm are generally vertical. The first arm 112 is connected to the first portion 116 of the further arm, and the second arm 114 is connected to the second portion 118 of the further arm. In the embodiment shown the first arm 112 and first portion 116 of the further arm are formed from a single section of tubing including a 90° bend. Similarly, the second arm 114 and the second portion 118 of the further arm are also formed from a single section of tubing including a 90° bend.

The first portion 116 of the further arm is connected to the second portion 118 of the further arm by means of a primary joint 120. The primary joint 120 is a swivelling joint in accordance with U.S. Pat. No. 6,957,832, the contents of which are incorporated herein by reference.

It will thus be appreciated that the second arm 114 is arranged to rotate relative to first arm 112 about an axis of rotation oriented at 45° to a longitudinal axis of the first portion 116 of the further arm.

The primary joint 120 includes a positioning means using four clamping bolts 130. The clamping bolts 130 combine with force distributing plates 131 to clamp the primary joint 120 at a desired orientation. Loosening of the clamping bolts 130 permits rotation of the second portion 118 of the further arm relative to the first portion 116 of the further arm, while tightening of the clamping bolts 130 restricts this rotation.

The primary joint 120 further includes a securing pin 132. At least two of the force distributing plates 131 include pin receiving apertures 134, which align when the primary joint 120 is in the orientation shown in FIG. 11. In the first position shown in FIG. 11, the securing pin 132 can be located within the pin receiving apertures 134 in order to prevent relative rotation of the first and second portions 116, 118 of the further arm. The securing pin 132 thus acts as an additional safety mechanism for the supporting structure 110.

The supporting structure 110 also includes a secondary joint, not shown in FIG. 11. The secondary joint is located in the connection of the primary joint 120 to the first portion 116 of the further arm. This connection is by means of a sleeve connection, where a lower end of the primary joint 120 includes a hollow tubular section which locates about an upper end of the first portion 116 of the second arm.

The arrangement is such that the primary joint 120, and therefore the second arm 114, are able to rotate about an axis of rotation determined by the first portion 116 of the further arm. In practice, this secondary joint allows rotation about a vertical axis, being one parallel with a light pole 10 to which the supporting structure 110 is connected.

The secondary joint includes a pin. The first portion 116 of the further arm includes a number of circumferential apertures which are arranged to accept the pin of the secondary joint. Accordingly, the relative rotational position of the primary joint 120 and the first portion 116 of the further arm can be selected to correspond with one of the circumferential apertures.

The first arm 112 and the second arm 114 are the same length, and both extend from inner ends connected to the further arm to outer ends remote from the further arm.

Each of the outer ends of the first and second arms 112, 114 has a locator, or clamp 140, mounted to it.

The clamp 140 is formed with a connecting portion, which is tubular, and a gripping portion 144. The connecting portion is sized so as to locate within the outer end of the first arm 112 or the second arm 114 in a telescoping manner. The connecting portion 142 includes bolt receiving apertures which are arranged to align with similar apertures on the first or second arms 112, 114. Holding bolts 148 can then be passed through the apertures of the first or second arm 112, 114 and the bolt receiving apertures in order to hold the clamp 140 in position.

In an alternative arrangement (not shown), the first and second arms 112, 114 can be formed with flanges at their respective outer ends, and the clamps 140 equipped with corresponding flanges. The clamps 140 can therefore be secured in position by use of a plurality of bolts arranged around a flanged connection.

The gripping portion 144 includes a fixed arm 150, a pivoting arm 152 and a restraining bolt 154 which extends from the fixed arm 150 and which is arranged to be received within a catching portion 156 of the pivoting arm 152. The arrangement is such that when the clamp 140 is brought against a pole, the pivoting arm 152 can be closed around the pole such that the pole is gripped between the fixed arm 150 and the pivoting arm 152. The restraining bolt 154 can then be tightened so that the clamp 140 closely grips the pole.

Figure 12:
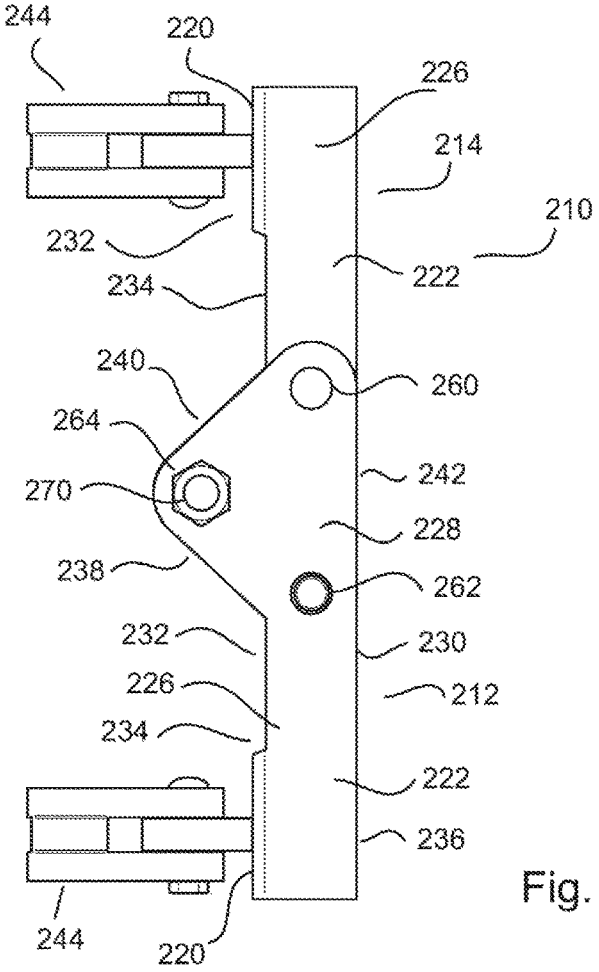
FIG. 12 is a side view of a hinged support used in the method of FIGS. 1 to 10; shown in a first configuration.
Figure 13:
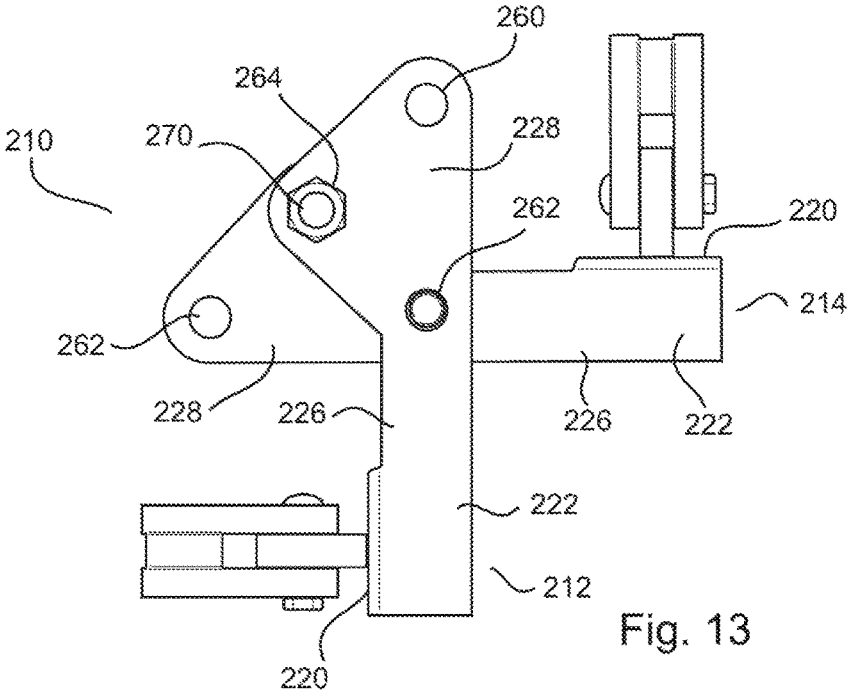
FIG. 13 is a side view of the hinged support of FIG. 12 shown in a second configuration.
Figure 14:
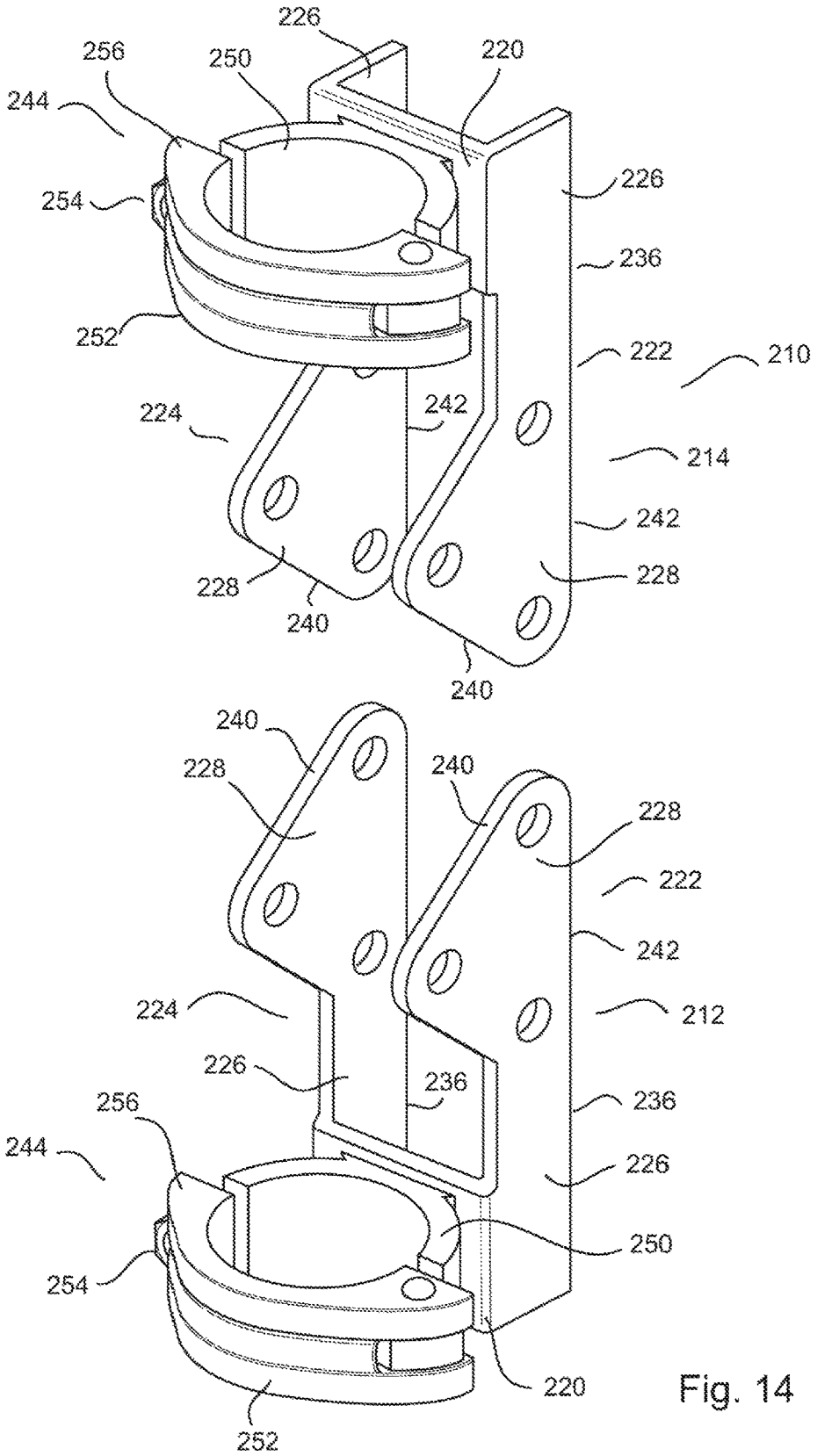
FIG. 14 is an exploded view of the hinged support of FIG. 12.

Referring to FIGS. 12 to 14, there is shown a hinged support 210. The hinged support 210 includes a first member 212 and a second member 214. The first member 212 and the second member 214 are substantially mirror-images of each other.

Each of the first member 212 and the second member 214 include an attachment portion 220, a first side flange 222 and a second side flange 224. The first and second side flanges 222, 224 each include a generally rectangular rear portion 226 and a generally triangular connection portion 228.

Each of the first and second flanges 222, 224 has an outer edge 230 and an inner edge 232. The outer edge 230 is straight. The inner edge 232 has three sections: a rear section 234 which is parallel to and spaced from a rear section 236 of the outer edge 230; a middle section 238, and a front section 240. The rear section 234 of the inner edge 232 and the rear section 236 of the outer edge 230 define the longer edges of the generally rectangular rear portion 226. The middle section 238 of the inner edge 232, the front section 240 of the inner edge 232, and a front section 242 of the outer edge 230 together define the generally triangular connection portion 228.

The connection portion 228 is in the general form of a right isosceles triangle, with the front section 242 of the outer edge 230 forming the hypotenuse. It will therefore be appreciated that both the middle section 238 and the front section 240 of the inner edge 232 are disposed at 45° to the rear section 234 of the inner edge 232.

Each attachment portion 220 acts as a web between the rear portion 226 of the first side flange 222 and the second side flange 224, such that the rear of both the first member 212 and the second member is 214 is generally configured as a channel.

Each attachment portion 220 includes a gripping portion 244 similar to the gripping portion 144 of the supporting structure 110. The gripping portion 244 includes a fixed arm 250 which may be welded to the attachment portion 220, a pivoting arm 252 and a restraining bolt 254 which extends from the fixed arm 250 and which is arranged to be received within a catching portion 256 of the pivoting arm 252. The arrangement is such that when the gripping portion 244 is brought against the pole 10, the pivoting arm 252 can be closed around the pole such that the pole is gripped between the fixed arm 250 and the pivoting arm 252. The restraining bolt 254 can then be tightened so that the gripping portion 244 closely grips the pole.

The triangular connection portions 228 each include three apertures: a first aperture 260, a second aperture 262 and a hinge receiving aperture 264. These apertures may be considered as a primary aperture, being the hinge receiving aperture 264, and two subsidiary apertures being the first and second apertures 260, 262.

The three apertures are located close to the three points of the triangle forming the connection portion 228. The hinge receiving aperture 264 is located near the right angle; that is, near the connection of the middle section 238 and the front section 240 of the inner edge 232. In the first member 212, the first aperture 260 is located at the front of the connection portion 228; that is, near the connection of the front section 240 of the inner edge 232 and the front section 242 of the outer edge 230. The second aperture 262 is located at the rear of the connection portion 228; that is, near the connection of the middle section 238 of the inner edge 232 and the front section 242 of the outer edge 230. In the second member 214, the relative positions of the first and second apertures are exchanged.

In order for the hinged support 210 to be formed, the first member 212 and the second member 214 are brought together such that the connection portions 228 are adjacent. In the example of the drawings, the arrangement is such that the connection portion 228 of the first side flange 222 of the first member 212 is inside the connection portion 228 of the first side flange 222 of the second member 214, and the connection portion 228 of the second side flange 224 of the first member 212 is outside the connection portion 228 of the second side flange 224 of the second member 214.

In this configuration, it will be appreciated that the first apertures 260 of the first member 212 will be aligned with the first apertures 260 of the second member 214; the second apertures 262 of the first member 212 will be aligned with the second apertures 262 of the second member 214; and the hinge receiving apertures 264 of the first member 212 will be aligned with the hinge receiving apertures 264 of the second member 214.

The first member 212 is joined to the second member 214 by using two axial connection members being hinge bolts 270: one passing through the hinge receiving apertures 264 of the first side flanges 222 of the first and second members 212, 214; and the other passing through the hinge receiving apertures 264 of the second side flanges 224 of the first and second members 212, 214. It will be appreciated that the two hinge bolts 270 are located along a common axis, which defines the hinge axis of the hinged support 210. It will also be appreciated that the hinge bolts 270 are spaced from each other by the width of the attachment portions 220.

The arrangement is such that when the hinged support 210 is in the configuration described, with respective first and second apertures 260, 262 of the first and second members 212, 214 aligned, and the hinged support 210 is mounted to the light pole 10 by means of the gripping portions 244, then the hinge axis will be approximately tangential to the light pole 10.

It will be appreciated that the hinged support 210 can be moved between two configurations: a first configuration as shown in FIG. 12 in which the first member 212 and the second member 214 are parallel, and a second configuration as shown in FIG. 13 in which the first member 212 and the second member 214 are perpendicular. Movement between the configurations can be achieved by relative rotation of the first and second members 212, 214 about the hinge bolts 270.

When in the first configuration, the respective first and second apertures 260, 262 of the first and second members 212, 214 are aligned as described above. When in the second configuration, the first apertures 260 of the second member 214 become aligned with the second apertures 262 of the first member 212, as can be seen in FIG. 13.

Figure 1:
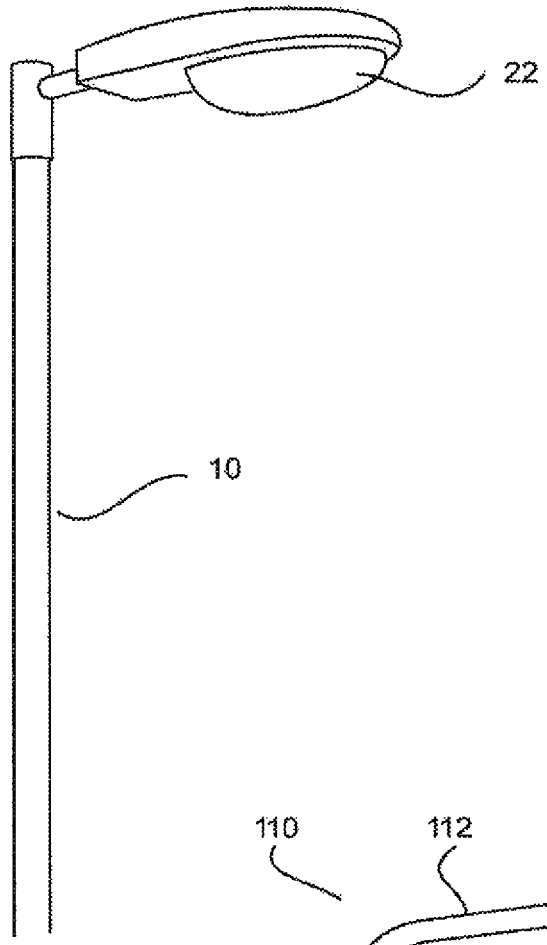
Fig. 1 PRIOR ART
FIGS. 1 to 10 are sequential perspectives of a light pole into which a joint is to be installed using at least one method of the present invention.

The method of installing the joint 12 into the light pole 10 is shown in FIGS. 1 to 10. FIG. 1 shows the light pole 10 prior to installation of the joint 12.

The first action is to locate the desired position 14 for the joint 12, along the light pole 10. When this has been determined, the supporting structure 110 is attached to the light pole 10 by means of the clamps 140. The arrangement is such that the first arm 112 is located above the desired position 14, and the second arm 114 is located below the desired position 14. The first and second portions 116, 118 of the further arm of the supporting structure 110 are substantially parallel to, and spaced from, the light pole 10.

The supporting structure 110 is locked into position about the light pole 10 by tightening of the restraining bolts 154. This is shown in FIG. 2.

Once the supporting structure 110 is locked into position, the light pole 10 can be cut at the position 14 by a suitable rotary cutter 15. Care must be taken not to damage any wires passing internally of the light pole 10. Once cutting is complete, the light pole is in two parts: a fixed portion 16 mounted to a base, and a free portion 20 including a light source 22. The fixed portion 16 and the free portion 20 are separated at a cut 24.

Figure 3:
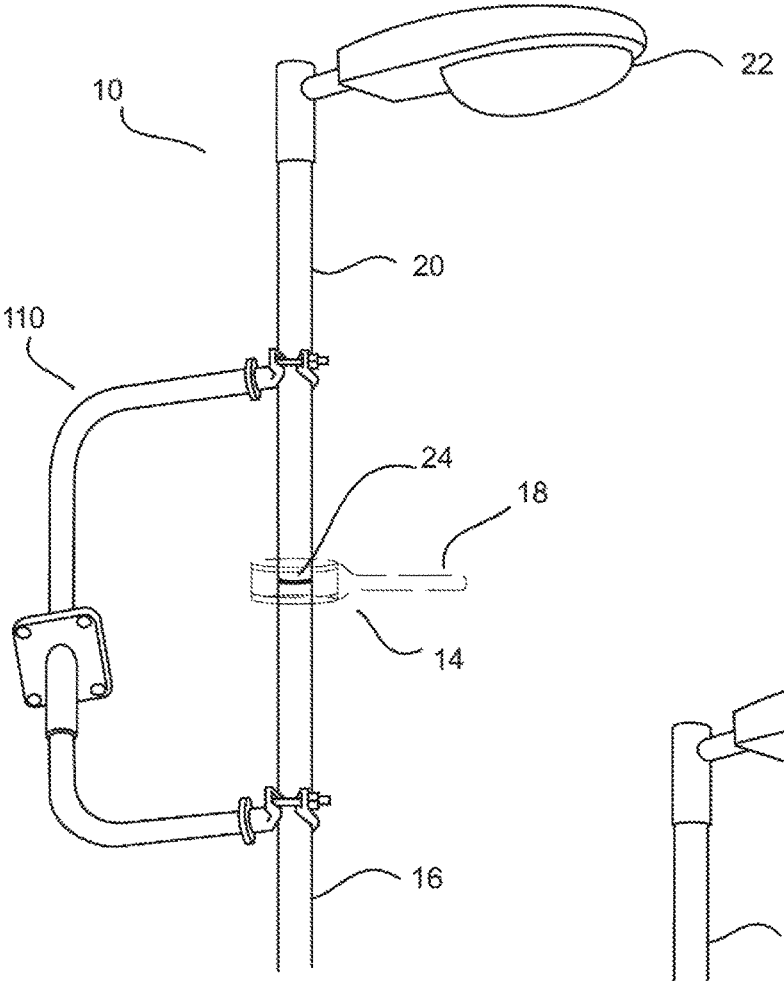

At this stage of the installation, as shown in FIG. 3, the supporting structure 110 holds the free portion 20 relative to the fixed portion 16, preventing relative movement.

The hinged support 210 in its first configuration is now fixed to the light pole 10, with the first member 212 being connected to the fixed portion 16 by use of its gripping portion 244, and the second member 214 being connected to the free portion 20 by use of its gripping portion 244. The hinged support 210 is positioned such that the hinge bolts 270 are aligned with the cut 24 in the light pole 10. In the embodiment shown, the hinged support 210 is sized relative to the light pole 10 such that the hinge axis is tangential to the (circular) cut 24.

Figure 4:
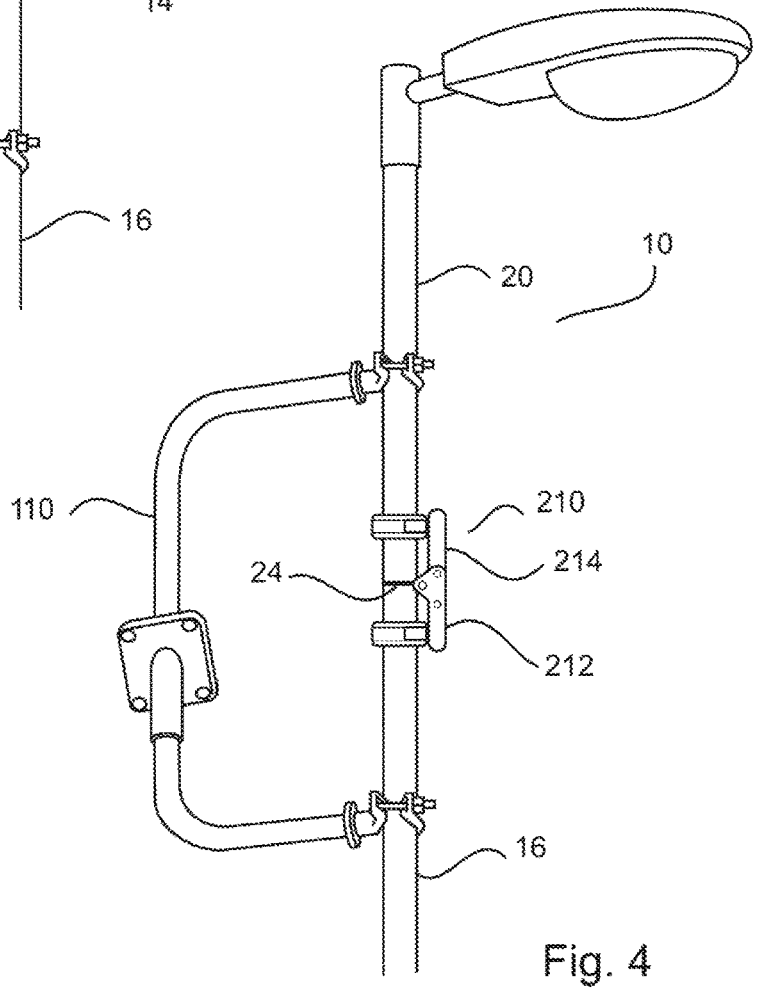

The hinged support 210 is locked into position about the light pole 10 by tightening of the restraining bolts 254. In addition, the hinged support 210 is maintained in its first configuration by the insertion of a pin through the aligned first apertures 260. This is shown in FIG. 4.

Figure 5:
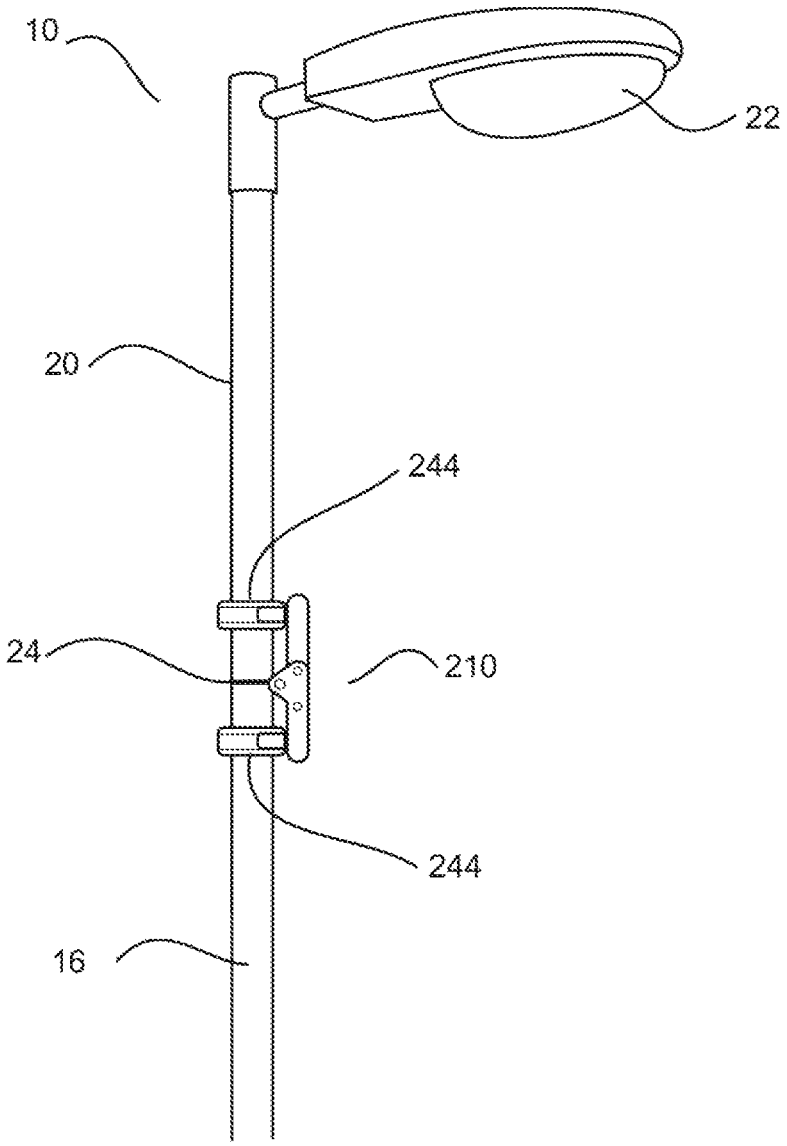

Once the hinged support 210 has been secured into position, the supporting structure 110 can be safely removed. At this stage of the installation, as shown in FIG. 5, the hinged support 210 holds the free portion 20 relative to the fixed portion 16, preventing relative movement.

The hinged support 210 can now be carefully moved into its second configuration, thus rotating and hence lowering the free portion 20 of the light pole 10 relative to the fixed portion 16. In order for this to achieved, the pin must be removed from the first apertures 260. Once the hinged support is in its second configuration, the pin can be reinserted into the aligned first and second apertures 260, 262.

Figure 6:
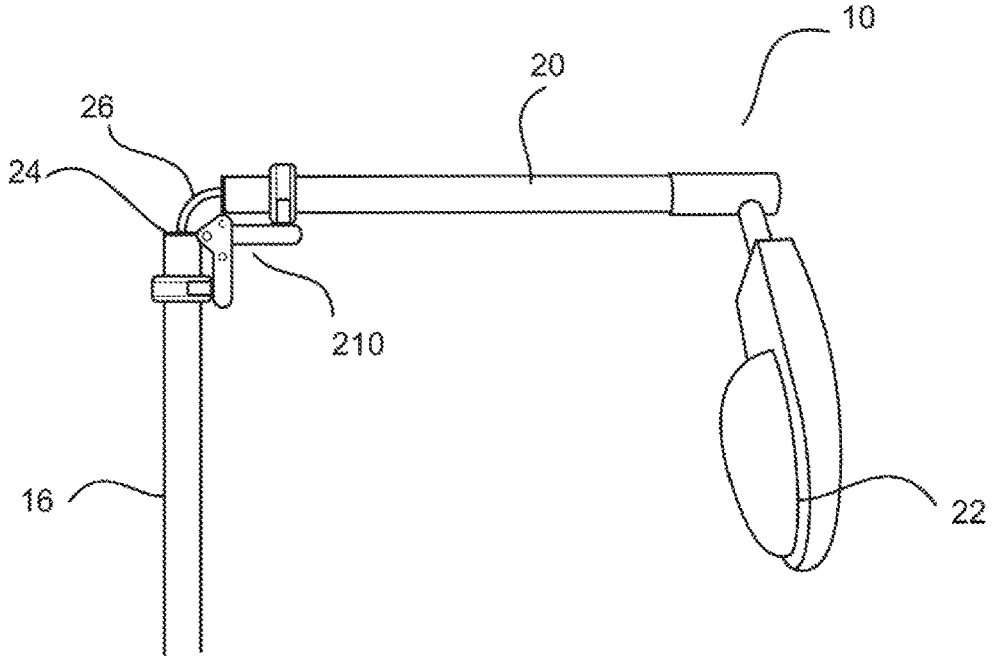

It will be appreciated that the free portion 20 of the light pole 10 is now disposed at 90° to the fixed portion 16. This is shown in FIG. 6.

It will also be appreciated that the free portion 20 and, importantly, any wiring 26 inside the free portion 20, has been rotated about the hinge axis, tangential to the light pole 10. This means that the radius of curvature of the wiring 26 is extremely small, and in consequence there is little or no stretching of the wiring 26.

Figure 7:
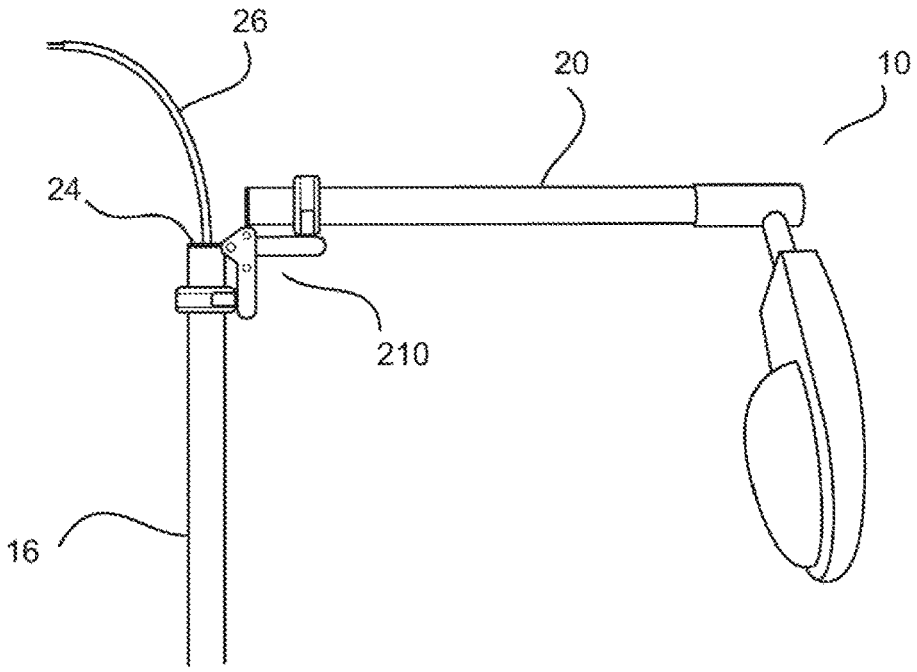

Once the hinged support 210 has been secured in its second configuration by use of the pin, the undamaged wiring 26 can be safely disconnected from the light source 22, and withdrawn from the free portion 20 of the light pole 10. This is shown in FIG. 7.

Figure 8:
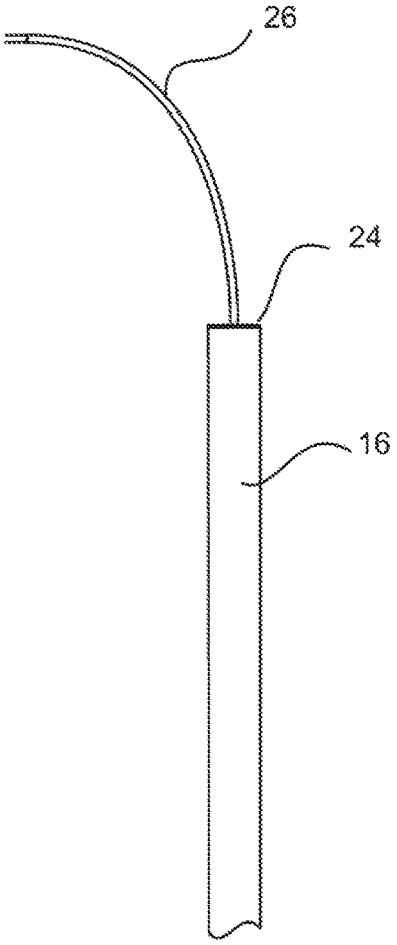
Figure 9:
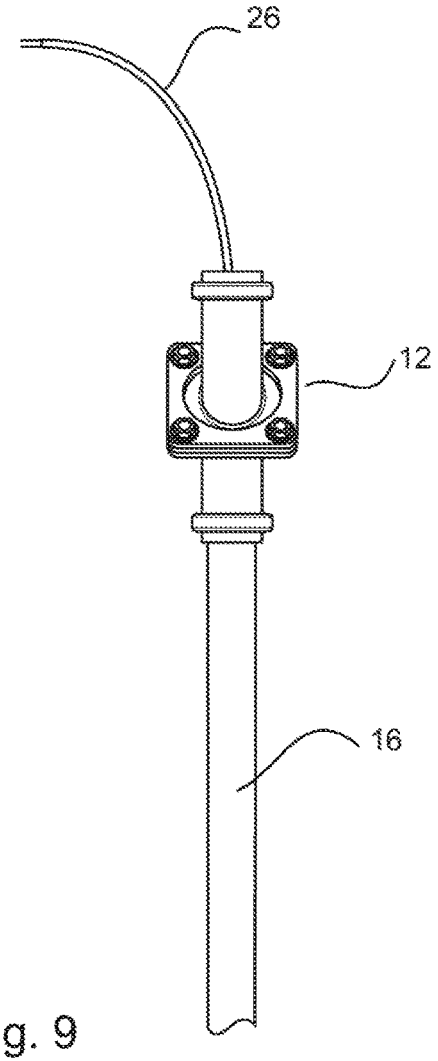

With no internal wiring now passing through the free portion 20, the free portion 20 and the hinged support 210 can be safely removed, leaving only the fixed portion 16 from which the wiring 26 protrudes. This is shown in FIG. 8. The wiring 26 can be passed through the joint 12 as it attached around the cut end 24 of the fixed portion 16 of the light pole 10, as shown in FIG. 9.

Figure 10:
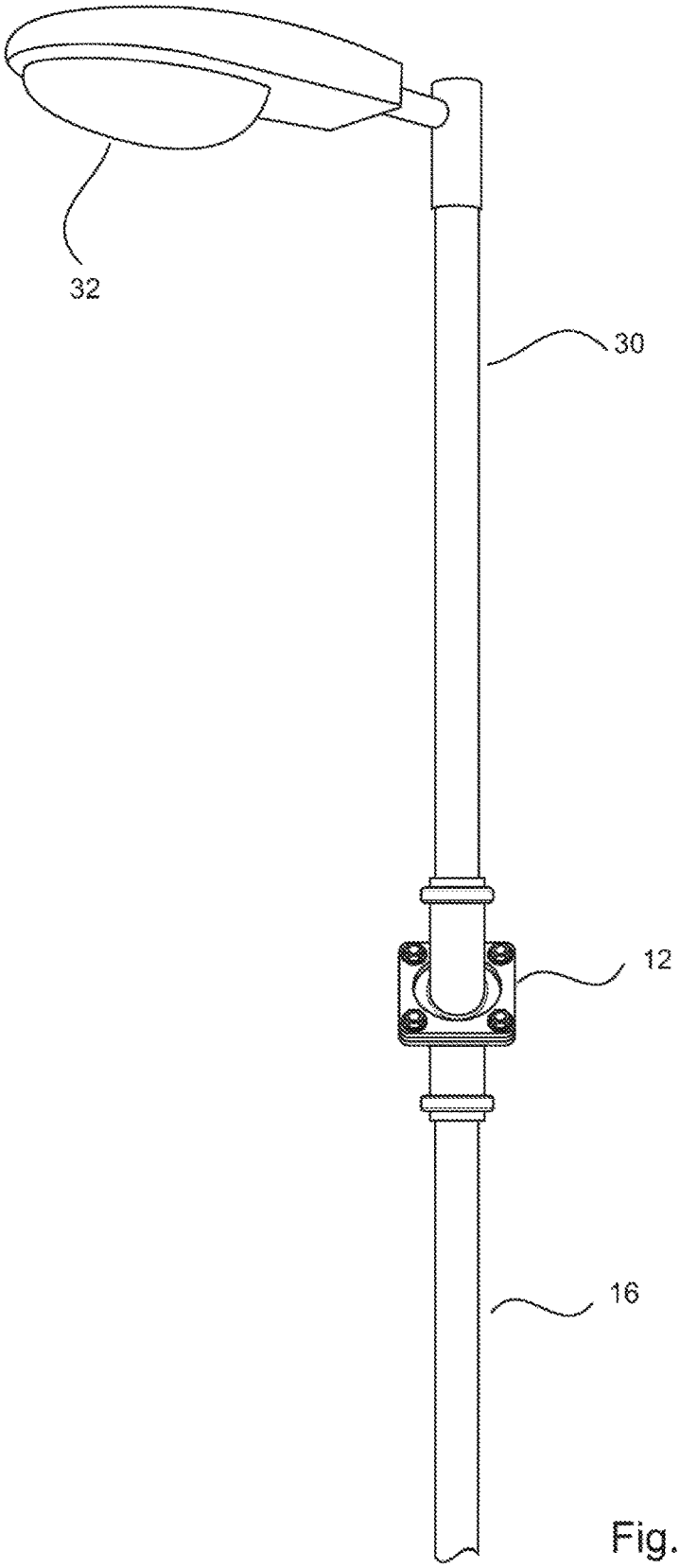

Finally, a new free portion 30 including a new light source 32 can be located onto the joint 12, as shown in FIG. 10.

An alternative method and supporting structure is shown in FIGS. 15 to 19.

Figure 15:
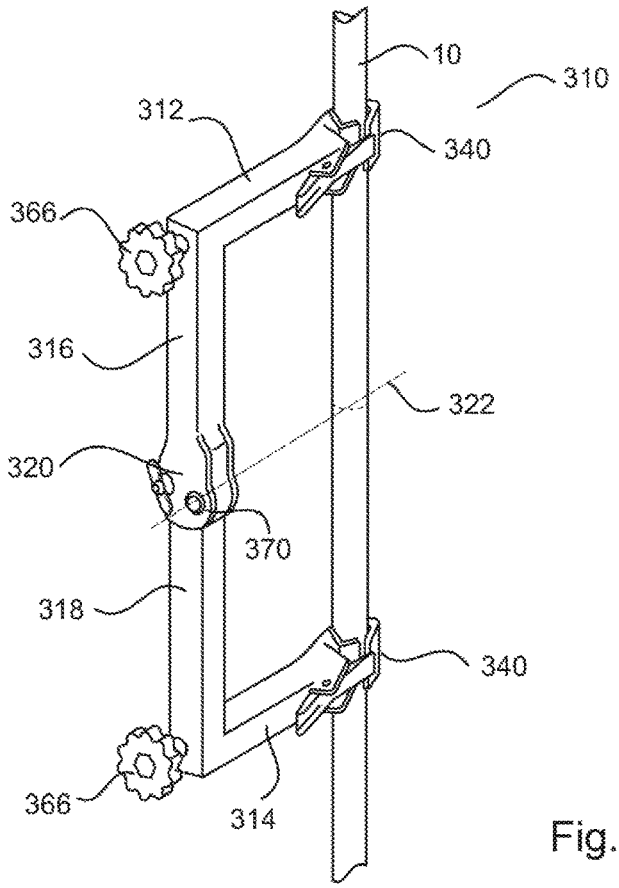
FIG. 15 is a perspective of a hinged supporting structure in accordance with some aspects of the present invention, shown in a first configuration.

Referring to FIG. 15, there can be seen a supporting structure 310 comprising a first arm 312, a second arm 314, and a further arm having a first portion 316 and a second portion 318.

In the position shown in FIG. 15 the first arm 312 and the second arm 314 are generally horizontal, and the first and second portions 316, 318 of the further arm are generally vertical. The first arm 312 is connected to the first portion 316 of the further arm, and the second arm 314 is connected to the second portion 318 of the further arm. In the embodiment shown the first arm 312 and first portion 316 of the further arm are formed from a single section of tubing including a 90° bend. Similarly, the second arm 314 and the second portion 318 of the further arm are also formed from a single section of tubing including a 90° bend.

The first portion 316 of the further arm is connected to the second portion 318 of the further arm by means of a hinged connection 320.

Each of the outer ends of the first and second arms 312, 314 has a locator, or clamp 340, mounted to it.

Figure 19:
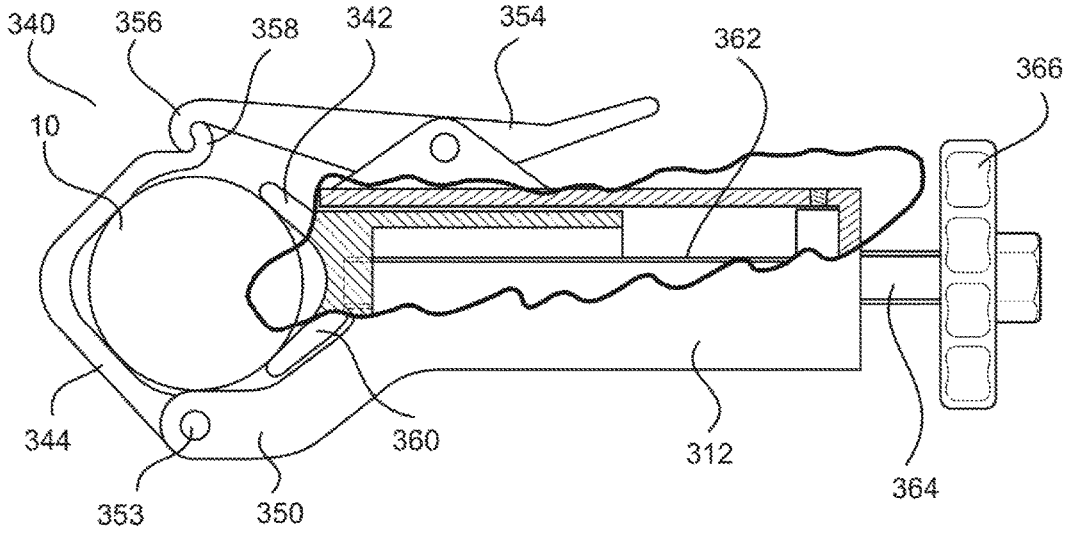
FIG. 19 is a partially cut-away plan view of the hinged supporting structure of FIG. 15.

The operation of the clamp 340 can be seen in more details in FIG. 19, which shows the clamp from the first arm 312.

The clamp 340 includes an engaging portion 342 and an encircling portion 344. The encircling portion 344 includes a curved fixed arm extension 350 which extends from the end of the first arm 312 about a curve arranged to pass about 90° around a pole 10. The encircling portion 344 also includes a pivoting arm 352, which is generally right angled and is arranged to pass around 180° of the pole 10. The pivoting arm 352 is connected to the fixed arm extension 350 at a pivot 353.

A catch 354 is pivotally connected to the first arm 312 at a side opposed to the fixed arm extension 350. The catch 354 has a hook 356 at an outer end thereof, arranged to engage with a hook 358 at an outer end of the pivoting arm 352. The catch 354 is biased (for instance, by use of a spring) into a position where the hooks 354, 356 engage each other, thus causing the encircling portion 344 to pass around the pole 10.

The engaging portion 342 has a cradle 360 at an outer end thereof, extending from the first arm 312. The cradle 360 is mounted to a shaft 362 which extends internally of the first arm 312, and which includes a threaded connection to the first arm 312. The shaft 362 extends through the first arm 312, terminating in an outer extension 364 located at the first portion 316 of the further arm.

The outer extension 364 is mounted to a driving wheel 366 located outside the first portion 316 of the further arm. The arrangement is such that turning of the driving wheel 366, which may be manually operated, is translated via the threaded connection into axial movement of the shaft 362 and thus the cradle 360.

The clamp 340 can thus be secured to the pole 10 by firstly opening the catch 354; pivoting the pivoting arm 352 into an open position; locating the clamp 340 generally about the pole 10 and closing the pivoting arm 352; operating the catch 354 to engage the hook 358 and thus encircle the pole 10; and then operating the driving wheel 366 to urge the cradle 360 against the pole 10 until the pole 10 is rigidly clamped between the cradle 360 and the pivoting arm 344.

The first portion 316 of the further arm is joined to the second portion 318 of the further arm by an axial connection member being a hinge bolt 370. The hinge bolt 370 is perpendicular to an elongate axis of the further arm, and parallel to the first arm 312 and the second arm 314. The hinge bolt 370 is located along one side of the further arm, rather than passing through the elongate axis. The hinge bolt 370 defines a hinge axis of the supporting structure 310

The arrangement is such that when the supporting structure 310 is mounted to the light pole 10 by means of the clamps 340, then the hinge axis will be approximately tangential to the light pole 10.

Figure 16:
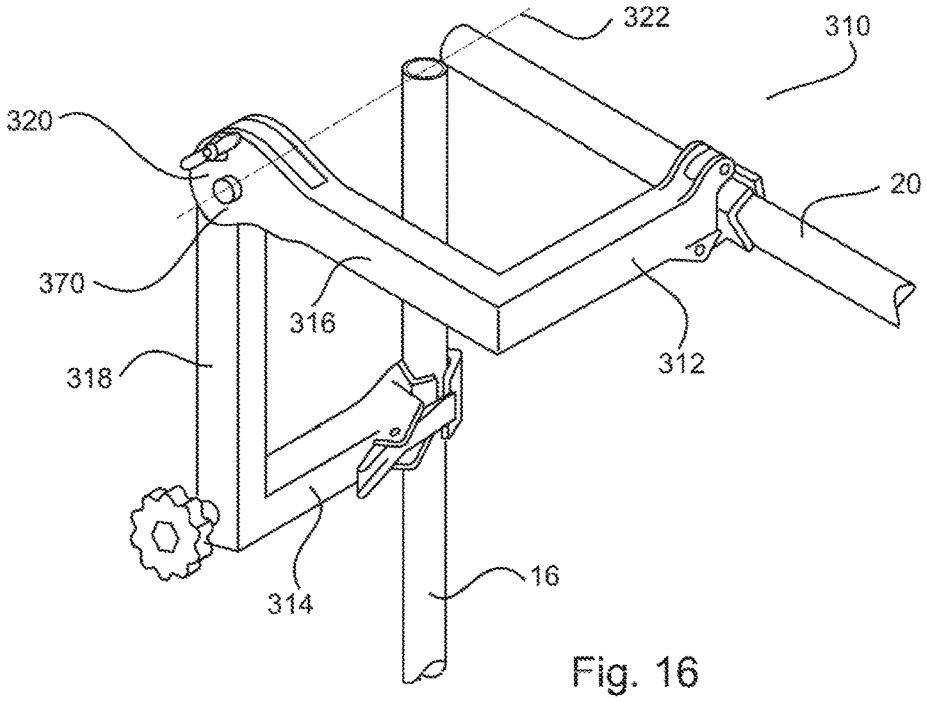
FIG. 16 is a perspective of the hinged supporting structure of FIG. 15, shown in a second configuration.
Figure 17:
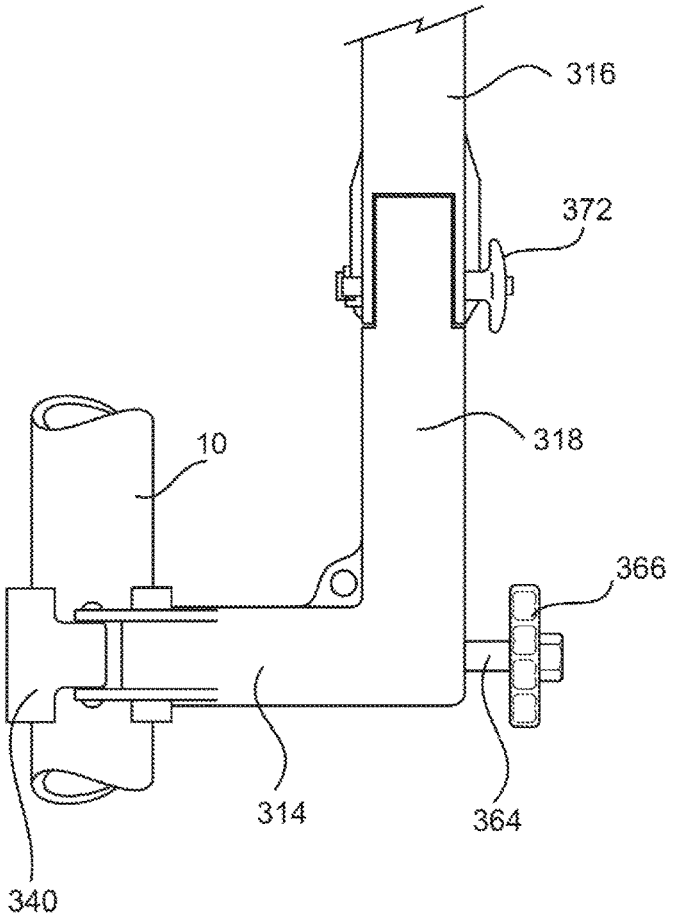
FIG. 17 is a side view of a lower portion of the hinged supporting structure of FIG. 15.

It will be appreciated that the supporting structure 310 can be moved between two configurations: a first configuration as shown in FIG. 15 in which the first member 312 and the second member 314 are parallel, and a second configuration as shown in FIG. 16 in which the first member 312 and the second member 314 are perpendicular. Movement between the configurations can be achieved by relative rotation of the first and second members 312, 314 about the hinge bolt 370.

The first arm portion 316 has a first aperture (not shown) which is parallel to, and laterally spaced from the hinge bolt 370. The second arm portion 318 has a corresponding first aperture, such that when the supporting structure 310 is in the first configuration then a pin 372 can be located within the aligned first apertures, securing the supporting structure 310 in the first configuration.

Figure 18:
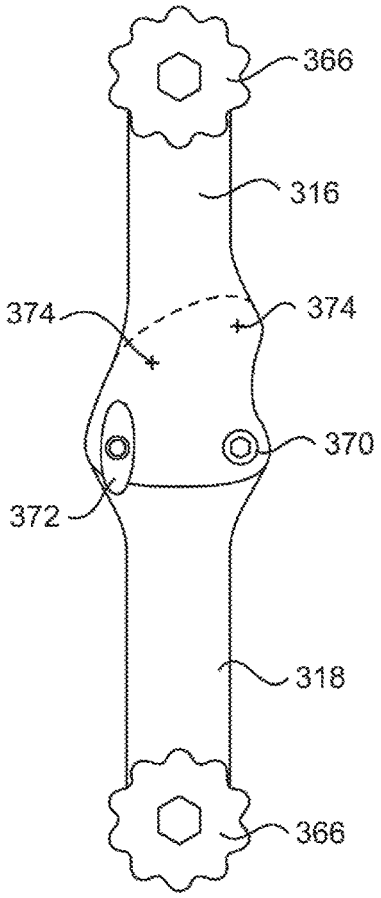
FIG. 18 is an end view of the hinged supporting structure of FIG. 15.

The second arm portion 318 has further apertures, at locations 374 shown on FIG. 18. The locations 374 are such that the first apertures of the first arm portion aligns with further apertures of the second arm portion when the supporting structure 310 is in the second configuration, or indeed in an intermediate configuration. The pin 372 can thus be used to secure the supporting structure in a desired configuration.

A method of installing the joint 12 into the light pole 10 using the supporting structure 310 will now be described.

The first action is to locate the desired position 14 for the joint 12, along the light pole 10. When this has been determined, the supporting structure 310 is attached to the light pole 10 by means of the clamps 340. The arrangement is such that the first arm 312 is located above the desired position 14, and the second arm 314 is located below the desired position 14. The first and second portions 316, 318 of the further arm of the supporting structure 310 are substantially parallel to, and spaced from, the light pole 10.

The supporting structure 310 is locked into position about the light pole 10 by tightening of cradles 342 using the driving wheels 366.

Once the supporting structure 310 is locked into position, the light pole 10 can be cut at the position 14 by a suitable rotary cutter 15. Care must be taken not to damage any wires passing internally of the light pole 10. Once cutting is complete, the light pole is in two parts: a fixed portion 16 mounted to a base, and a free portion 20 including a light source 22. The fixed portion 16 and the free portion 20 are separated at a cut 24.

At this stage of the installation, the supporting structure 310 holds the free portion 20 relative to the fixed portion 16, preventing relative movement.

The supporting structure 310 can now be carefully moved into its second configuration, thus rotating and hence lowering the free portion 20 of the light pole 10 relative to the fixed portion 16. In order for this to achieved, the pin 372 must be removed from the first apertures. Once the supporting structure 310 is in its second configuration, the pin can be reinserted into the aligned first and further apertures.

It will be appreciated that the free portion 20 of the light pole 10 is now disposed at 90° to the fixed portion 16. This is shown in FIG. 16.

It will also be appreciated that the free portion 20 and, importantly, any wiring 26 inside the free portion 20, has been rotated about the hinge axis 322, tangential to the light pole 10. This means that the radius of curvature of the wiring 26 is extremely small, and in consequence there is little or no stretching of the wiring 26.

Once the supporting structure 310 has been secured in its second configuration by use of the pin 372, the undamaged wiring 26 can be safely disconnected from the light source 22, and withdrawn from the free portion 20 of the light pole 10.

With no internal wiring now passing through the free portion 20, the free portion 20 and the supporting structure 310 can be safely removed, leaving only the fixed portion 16 from which the wiring 26 protrudes. This is shown in FIG. 8. The wiring 26 can be passed through the joint 12 as it attached around the cut end 24 of the fixed portion 16 of the light pole 10, as shown in FIG. 9.

Finally, a new free portion 30 including a new light source 32 can be located onto the joint 12, as shown in FIG. 10.

Modifications and variations as would be apparent to a skilled addressee are deemed to be within the scope of the present invention. For instance, it will be apparent that the swivelling supporting structure 110 described herein could be readily replaced with a non-swivelling supporting structure, without effecting any change to the method of FIGS. 1 to 14 described above.

Having described the invention, the following is claimed:

1. A method of preparing a pole for installation of a joint, the pole having a longitudinal axis extending along a center of the pole and an initial volume delimited by an outer surface of the pole, the method including the steps of:

attaching a supporting structure to the pole, the supporting structure attaching to the pole at two longitudinally separated locations;

cutting the pole at a joint location between the longitudinally separated locations, thereby creating a fixed portion of the pole and a free portion of the pole, the free portion of the pole being held into position relative to the fixed portion of the pole by the supporting structure; and rotating the free portion of the pole relative to the fixed portion of the pole about a hinge of the supporting structure, said hinge entirely located outside a region between cross-sectional areas of the fixed and free portions of the pole such that the hinge is entirely external to the initial volume delimited by the pole, and the hinge having an axis of rotation located within one half of a characteristic thickness of the pole from the longitudinal axis, wherein the characteristic thickness is defined by the cross-sectional thickness of the pole as measured at the joint location.

2. A method of preparing a pole for installation of a joint as claimed in claim 1, wherein the supporting structure comprises:

a first arm having a first locator, the first locator being arranged to releasably attach to the pole;

a second arm having a second locator, the second locator being arranged to releasably attach to the pole;

a further arm connecting the first arm and the second arm, the further arm including a first portion and a second portion connected at said hinge, the first portion rotatable relative to the second portion about the axis of rotation of said hinge;

the axis of rotation of said hinge being perpendicular to the longitudinal axis of the pole when the first and second locators are attached to the pole;

whereby rotation of the first portion relative to the second portion about the hinge causes the second arm to move between a first position in which the first and second locators are aligned, and a second position in which the first and second locators are not aligned.

3. A method of preparing a pole for installation of a joint, the pole having a longitudinal axis extending along a center of the pole and an initial volume delimited by an outer surface of the pole, the method including the steps of:

attaching a supporting structure to the pole, the supporting structure attaching to the pole at two longitudinally separated locations;

cutting the pole at a joint location between the longitudinally separated locations, thereby creating a fixed portion of the pole and a free portion of the pole, the free portion of the pole being held in a single fixed position relative to the fixed portion of the pole by the supporting structure;

attaching a hinged support about the joint location, with the hinged support attaching to the fixed portion of the pole and the free portion of the pole, the hinged support comprising a hinge that is entirely located outside a region between cross-sectional areas of the fixed and free portions of the pole such that the hinge is entirely external to the initial volume delimited by the pole, said hinge having an axis of rotation within one half of a characteristic thickness of the pole from the longitudinal axis of the pole, wherein the characteristic thickness is defined by the cross-sectional thickness of the pole as measured at the joint location;

removing the supporting structure; and rotating the free portion of the pole relative to the fixed portion of the pole about the hinge of the hinged support.

4. A method of preparing a pole for installation of a joint as claimed in claim 3, wherein the method includes the further step of removing wiring from the free portion of the pole.

5. A method of installing a joint in a pole, the pole having a longitudinal axis extending along a center of the pole and an initial volume delimited by an outer surface of the pole, the method including the steps of:

attaching a supporting structure to the pole, the supporting structure attaching to the pole at two longitudinally separated locations;

cutting the pole at a joint location between the longitudinally separated locations, thereby creating a fixed portion of the pole and a free portion of the pole, the free portion of the pole being held in a single fixed position relative to the fixed portion of the pole by the supporting structure;

attaching a hinged support to the pole about the joint location, with the hinged support attaching to the fixed portion of the pole and the free portion of the pole, the hinged support comprising a hinge that is entirely located outside a region between cross-sectional areas of the fixed and free portions of the pole such that the hinge is entirely external to the initial volume delimited by the pole, said hinge having an axis of rotation within one half of a characteristic thickness of the pole from the longitudinal axis of the pole, wherein the characteristic thickness is defined by the cross-sectional thickness of the pole as measured at the joint location;

removing the supporting structure;

rotating the free portion of the pole relative to the fixed portion of the pole about the hinge of the hinged support;

removing wiring from the free portion of the pole;

removing the free portion of the pole and the hinged support; and attaching a joint to the fixed portion of the pole at the joint location.

6. A method of preparing a pole for installation of a joint as claimed in claim 1, wherein the pole is a light pole.

7. A method of preparing a pole for installation of a joint as claimed in claim 1, wherein the pole is a light pole in excess of 2 m in height.

8. A method of preparing a pole for installation of a joint as claimed in claim 3, wherein the hinged support comprises a first member and a second member, each of the first member and the second member having attachment portions for attaching to the pole, the first member and the second member being connected such that the first member can rotate relative to the second member about the axis of rotation of said hinge.

9. A method of preparing a pole for installation of a joint as claimed in claim 8, wherein the axis of rotation of said hinge is perpendicular to the longitudinal axis of the pole.

10. A method of preparing a pole for installation of a joint as claimed in claim 9, wherein the axis of rotation of said hinge is tangential to the pole.

11. A method of preparing a pole for installation of a joint as claimed in claim 8, wherein the first member and the second member of the hinged support each include two connection portions, laterally spaced such that when the hinged support is attached to the pole the first connection portions of the first and second members may be located on one side of the pole, and the second connection portions of the first and second members may be located on an opposite side of the pole.

12. A method of preparing a pole for installation of a joint as claimed in claim 11, wherein the first connection portion of the first member is connected to the first connection portion of the second member by an axial connecting member.

13. A method of preparing a pole for installation of a joint as claimed in claim 12, wherein the second connection portion of the first member is connected to the second connection portion of the second member by an axial connecting member, with the two axial connecting members both being located along the axis of rotation of said hinge.

14. A method of preparing a pole for installation of a joint as claimed in claim 11, wherein the first connection portion of the first member and the first connection portion of the second member both include subsidiary apertures, such that a first aperture of the first member is aligned with a first aperture of the second member when the hinged support is in a first configuration.

15. A method of preparing a pole for installation of a joint as claimed in claim 14, wherein the first aperture of the first member is aligned with a second aperture of the second member when the hinged support is in a second configuration.

16. A method of installing a joint in a pole as claimed in claim 5, wherein the hinged support comprises a first member and a second member, each of the first member and the second member having attachment portions for attaching to the pole, the first member and the second member being connected such that the first member can rotate relative to the second member about the axis of rotation of said hinge, the axis of rotation of said hinge being perpendicular to the longitudinal axis of the pole.

* * * * *